United States Patent [19]

Maier

[11] Patent Number: 4,806,276

[45] Date of Patent: Feb. 21, 1989

[54] ADDITIVE FOR TRANSFORMER OILS

[76] Inventor: Bruce R. Maier, 3000 Woodbine, Columbia, Mo. 65203

[21] Appl. No.: 130,014

[22] Filed: Dec. 8, 1987

[51] Int. Cl.[4] ..... H01B 3/24

[52] U.S. Cl. ..... 252/570; 252/162; 252/171; 252/172; 252/400.1; 585/6.6

[58] Field of Search ..... 252/162, 171, 172, 400.1, 252/570; 585/6.6

[56] References Cited

U.S. PATENT DOCUMENTS

| | | | |
|---|---|---|---|
| 3,772,195 | 11/1973 | Francen | 252/8.05 |
| 3,954,882 | 5/1976 | Kalopissis et al. | 424/70 |
| 4,169,076 | 9/1979 | Kawakami et al. | 252/558 |
| 4,207,421 | 6/1980 | Scardera et al. | 568/625 |
| 4,238,373 | 12/1980 | Hardy et al. | 252/546 |
| 4,242,516 | 12/1980 | Mueller | 546/248 |

OTHER PUBLICATIONS

Anon., "Nonflammable substitute for PCB introduced in U.K.," Chem. & Eng. News, vol. 62, No. 13, Mar. 26, 1984.

Sanders, "The totally non-flammable transformer," Electronics and Power, May, 1986, pp. 361–363.

SCS, "Pyrolysis and Combustion of PCB Substitutes," EPRI Report Project 2028-12, Mar. 1986, pp. S-2-S-4 and 4-1-4-4.

Moore, *Fire Protection Handbook*, 16th ed., Section 19, Ch. 2, "Halogenated Agents and Systems".

*Primary Examiner*—Robert A. Wax

*Attorney, Agent, or Firm*—Kokjer, Kircher, Bradley, Wharton, Bowman & Johnson

[57] ABSTRACT

An additive for transformer oils comprising a non-ionic fluorosurfactant and a halogenated hydrocarbon where the co-mixture is a liquid at least 70° F. and methods for preparing and using same. The halogenated hydrocarbon is preferably chosen from the group comprising $C_1$–$C_3$ alkanes which can be fully halogenated or can retain some hydrogen atoms on the structure. The most preferred halogenated hydrocarbons being dibromotetrafluoroethane, dibromodifluoromethane or bromochloromethane. The most useful surfactants for use in this invention are those that are capable of dispersing and holding a halogenated hydrocarbon evenly throughout an oil. This is best accomplished through use of a non-ionic fluoro-surfactant. The additive of this invention can be used with any transformer oil to increase the useful life of the oil as well as to enhance the operational parameters of the transformer.

36 Claims, No Drawings

ADDITIVE FOR TRANSFORMER OILS

BACKGROUND OF THE INVENTION

This invention relates in general to an additive for transformer oils and more particularly to such an additive comprising a mixture of a surfactant and a halogenated hydrocarbon that is a liquid at room temperature.

Transformers are used in electricity and special voltage delivery systems. A transformer can be used to step-up or step-down voltage and change the voltage through electromagnetic induction. A typical high-voltage transformer has massive coil windings around a metal core. The coil winding is typically an insulated copper or other low resistivity metal wire and the core preferably comprises a plurality of thin steel laminations stacked side-by-side. Transformer coil windings of this type are known to breakdown after a period of time by oxidation of the coil windings, and by such occurrences as arcing, metal flaking and by the constant heat created by the transformers. This breakdown is greatly reduced by submersing the coil windings in an enclosed bath of oil. Most high-voltage transformers are oil-filled systems.

Transformer oils must, therefore, be able to enhance the performance of the transformer and prolong the useful life of the transformer before breakdown. The extremitus temperature range that transformer oils are subject to is between 0° F. and 350° F. The conventional operating range is between 60° F. and 190° F. Transformer oils have previously consisted of petroleum based naphthenic oils. It has been forecasted that the supply of such naphthenic oil will be depleted by 1990. As an alternative, petroleum based paraffinic oils and vegetable oils can be used as a suitable transformer oil. Paraffinic oils are generally straight carbon chains. Vegetable and paraffinic oils are more economical and ubiquitous, but have inconsistent breakdown characteristics that requires periodic monitoring, while in use in the transformer, as to its continued effectiveness.

Transformer oils do not have an infinite life span. Most transformer oils undergo auto-oxidation, decreases in pH, and other physical and/or chemical changes that ultimately permit the transformer to fail due to the inadequacies of the oil. Thus, transformer oil additives were developed to improve the longevity and characteristics of transformer oils, and the transformers themselves.

In order for a chemical compound to be an effective transformer oil additive, it must be capable of simultaneously raising or stabilizing the resistivity of the final mixture, maintaining and stabilizing the dielectric strength of the final mixture, and retarding the rate of oxidation of the oil. These objects must be met while also imparting heat stability and fire resistance to the final mixture. It is also important that the final mixture have a low level of environmental toxicity.

The primary reason for transformer oil breakdown, and subsequent transformer failure, is oxidation of the oil. When the oil is oxidized, hydrogen atoms are removed or freed from the oil's molecular chain. This causes the formation of a "free radical" or a highly active intermediate that has a tendency to shear itself and other chains into smaller chains. These smaller, sheared chains have a tendency to associate with available oxygen molecules or other radicals to form "hyperoxides." These chains, as hyperoxides, are capable of attacking the remaining chains to create more free radicals. This sequence of events causes the progressive hydrogen removal on the carbon chains of the oil. As a result, the oil which originally was long, organized carbon chains becomes short carbon chains with a reduced capability for heat transfer and a reduced dielectric strength. This breakdown is continual and self-perpetuating in that organic acids, which amplify the breakdown process, are a by-product of the reaction. Therefore, it is important that an additive for transformer oil have characteristics that limit the oxidation process and resulting breakdown of the oil.

Heretofore, the most widely used transformer oil additives were polychlorinated biphenyls (PCBs). PCBs are very effective in improving the longevity of transformers and transformer oils. Typically, a PCB would be added to the transformer oil to a concentration of greater than 1000 parts per million (ppm) of transformer oil.

Although polychlorinated biphenyls impart ideal characteristics to transformer oils, the use of polychlorinated biphenyls has been drastically reduced due to its extraordinary environmental hazard. Federal regulations now require that transformer oils contain less than 500 parts per million (ppm) polychlorinated biphenyls. Such uses of polychlorinated biphenyls in transformers are prohibited if the equipment poses a risk to food or feed. Federal regulations now also prohibit the manufacture of polychlorinated biphenyls.

Non-polychlorinated biphenyl containing transformer oils are now being used, but these oils are dramatically less effective in that they demonstrate poorer electrical resistance, greater flammability, and a higher tendency to oxidize with the resulting effect of compromising the power factor of the transformers. As a result, electric utilities and service organizations incur significant costs in recycling and exchanging non-polychlorinated biphenyl oils and must also frequently test the non-polychlorinated biphenyl containing oils to assure their continued effectiveness in protecting the transformer. A further consequence of using non-polychlorinated biphenyl oils is that more voltage step-down stations are needed where such stations were less necessary when polychlorinated biphenyl containing transformers were used.

It is thus evident that a need exists for a transformer oil additive that protects transformer oils and transformers from frequent breakdown and enhances the transformers capability and longevity, and that also has a relatively low level of toxicity.

A number of different chemicals or compounds have been tried as substitutes for the polychlorinated biphenyl additive for transformer oils. Pyrizolidines, sulphur compounds and other organo-aromatic compounds have been tried. But while these have been shown to decrease the oxidation of oil, they also decrease the oil's electrical resistivity thus making them less useful as a substitute additive.

Alkylbenzenes and other petroleum compounds have been experimented with and used as substitute additives. These compounds do increase electrical resistance of the oils, but they also auto-oxidize and are highly combustible so as to make the oil flash points dangerously low for safe and effective transformer applications. Additionaly, all of the above additives are considered to be relatively toxic.

SUMMARY OF THE INVENTION

I have discovered that a co-mixture comprising a surfactant and a halogenated hydrocarbon that is a liquid at at least 70° F. performs as an effective additive when combined with transformer oils.

Dense halogen substituted hydrocarbons have not heretofore been used in oil applications because when in the liquid phase they generally have a specific gravity greater than 1.8 gm/ml, whereas oil mixtures have a specific gravity of about 0.9 gm/ml. Thus, liquid halogenated hydrocarbons sink to the bottom of an oil mixture as an immiscible compound. Halogenated hydrocarbons also show low chemical activity and polarity thus preventing them from being dissolved in oil or most solvents by themselves.

In order to solve this problem, I have discovered that a liquid halogen substituted hydrocarbon can be blended with a surfactant and this co-mixture then suspended into, and mixed with, the transformer oil to form an evenly suspended halogenated hydrocarbon additive in the oil. As a result, this co-mixture creates an even dispersion of the halogenated hydrocarbon in the oil. The suspended halogenated hydrocarbon has a high dielectric strength, a high electrical resistance, and a high potential to inhibit the auto-oxidation breakdown of the commercial oil mixture. Additionally, spark generation and transformer arcing are rendered harmless to the oil by the evenly dispersed additive such that oxidation of the oil is further prevented. This additive can be used with any known transformer oil and is especially suited for use with an triacylglycerol oil having at least a 45 percent by weight $C_{22}$ alkene having a single double bond between carbons 9 and 10, counting from the methyl end of the molecule, as a functional group on the triacylglycerol and preferably a 100 percent by weight $C_{22}$ alkene having a single double bond between carbons 9 and 10 on the molecule, that has a chemical name glyceryl trierucate, as is described in my patent application entitled "An Oil For Use In Transformers and Other High Temperature Applications" filed on Dec. 8, 1987 which is incorporated herein by reference.

It is therefore a primary object of this invention to provide an additive for transformer oils that gives greater longevity to the functional operation of the oil by reducing the oxidative breakdown of the oil than other known additives.

It is a further object of the present invention to provide an additive for transformer oils that is comparatively less hazardous than additives previously or currently being used.

It is another object of the present invention to provide an additive for transformer oils that imparts a higher cup flash point temperature and auto-ignition temperature to the oil than other non-PCB containing additives.

It is a still further object of the present invention to provide an additive for transformer oils that improves and stabilizes the dielectric strength and electrical resistance of the oil while not compromising the rate of oxidation or flash point temperature of the oil.

It is an aim of the present invention to provide an additive for a transformer oil that enhances the useful operational life of a transformer while not presenting an environmental hazard.

It is a further aim of the present invention to provide an additive for a transformer oil that enhances the transformer power factor over other non-PCB additives being used.

Other and further objects of the invention, together with the features of novelty appurtenant thereto, will appear in the course of the following description of the invention.

DETAILED DESCRIPTION OF THE INVENTION

I have discovered that a mixture of a halogenated hydrocarbon that is a liquid at at least 70° F. and a surfactant is unexpectedly effective as an additive to transformer oils to increase the useful life of the oil as well as to enhance the operational parameters of the transformer.

The halogenated hydrocarbons useful in this invention are those that are liquid at room temperature. A particularly useful group of halogenated hydrocarbons is the group comprising $C_1$–$C_3$ alkanes. These alkanes can be fully halogenated with bromine, fluorine, chlorine, iodine or astatine atoms or can retain some hydrogen atoms on the structure and have a density of at least 1.8 g/mL. The halogenated hydrocarbons have the general formula $C_nZ$ where n is the number of carbon molecules on the chain and Z is either a halogen or hydrogen. The most useful halogenated hydrocarbons from the group defined above are bromochloromethane, dibromodifluoromethane or dibromotetrafluoroethane. The preferred compound for practicing this invention is dibromotetrafluoroethane.

The halogenated hydrocarbons can be prepared by known halogenation methods or can be purchased already prepared from commercial suppliers and are often referred to as halons.

Bromochloromethane has a chemical formula $CH_2BrCl$, is a liquid at room temperature and has a boiling point of about 151° F. Bromochloromethane has a specific gravity of 1.93 g/mL and a critical temperature of about 400° F. Critical temperature is defined as the temperature at which the liquid-vapor phase is no longer interconvertible; thus the liquid form of the compound does not exist above this temperature and does not reform upon a lowering of the temperature.

Dibromodifluoromethane has a chemical formula $CF_2Br_2$, is a liquid at ambient temperature, and has a boiling point of about 76° F. Its specific gravity is 2.28 g/mL and has a critical temperature of about 389° F.

Dibromotetrafluoroethane has a chemical formula $C_2F_4Br_2$, is a liquid at room temperature and has a boiling point of approximately 117° F. Its specific gravity is 2.17 g/mL and has a critical temperature of about 418° F.

The surfactants useful in this invention are those that are capable of dispersing and holding a halogenated hydrocarbon of the present invention evenly throughout an oil. Surfactants may be non-ionic, anionic, cationic or amphoteric and each type is useful in carrying out the present invention. The most useful group is the non-ionic surfactants. Within the group of non-ionic surfactants, non-ionic fluorosurfactants are the preferred surfactants. The most useful fluorosurfactants to be used in the present invention are Zonyl* FSN and Zonyl* FSN-100. (Zonyl* is a registered trademark of the Dupont Company, Wilmington, Del.) The preferred fluorosurfactant is Zonyl* FSN-100.

A surfactant is a surface active agent, such as a detergent, that exhibits the ability to lower the surface tension of an aqueous solution. Different types of surfactants are well known and the formulations therefor are described in various U.S. Patents such as Scardera et al, U.S. Pat. No. 4,207,421 issued June 10, 1980 (non-ionic surfactants); Hardy et al., U.S. Pat. No. 4,238,373 issued Dec. 9, 1980 (cationic surfactants); Kawakami et al., U.S. Pat. No. 4,169,076 issued Sept. 25, 1979 and Mueller U.S. Pat. No. 4,242,516 issued Dec. 30, 1980 (amphoteric surfactants). Surfactants can take on a variety of structures so long as they act as surface-active agents that lower the surface tension of solutions. Typically, surfactants are long chain hydrocarbons, often with alkoxy groups, nitrogen groups, sulphur groups or other chemicals or structures that impart surface active properties to the compound. These various surfactants may be fluorinated or not.

Non-ionic surfactants are the most useful group of surfactants for use in the present invention and the following formulas are typical of non-ionic surfactants:

$$R-O-(CH_2-CH_2-O)_a-(CH_2-\underset{\underset{R^1}{|}}{CH}-O)_b H$$

where

R is a linear alkyl hydrocarbon having an average of about 16 to 18 carbon atoms;

$R^1$ is methyl or ethyl;

a has an average value of 9 to 15;

b has an average value of 3 to 5; and the ratio of a:b being from 2.7:1–3.5:1. (as described in Scardera U.S. Pat. No. 4,207,421) or $$R-\underset{\underset{O+C_2H_3O-X\frac{}{}_q H}{|}}{CH}-CH_2-O+C_2H_3O-X\frac{}{}_p H$$

where

R is selected from the group consisting of alkyl, alkenyl, alkoxyalkyl and alkylaryloxyalkyl, having 8–22 carbons;

X is a $CH_2OH$;

p is a number between 0 and 10 inclusive;

q is a number between 0 and 10 inclusive; and p+q is a number between 1 and 10 inclusive. (as described in Kalopissis et al., U.S. Pat. No. 3,954,882 issued May 4, 1976). or $$R-\underset{\underset{O+C_2H_3O-Y\frac{}{}_q H}{|}}{CH}-CH_2-O+C_2H_3O-Y\frac{}{}_p H$$

where

R is selected from the group consisting of alkyl, alkenyl, alkoxyalkyl and alkylaryloxyalkyl, having 8–22 carbons;

p is a number between 0 and 10 inclusive;

q is a number between 0 and 10 inclusive; and p+q is a number between 1 and 10 inclusive.

Y is $CH_2Z$ or $CH_2OCH_2-CH=CH_2$ where Z is a halogen. (as described in Kalopissis et al., U.S. Pat. No. 3,954,882 issued May 4, 1976).

Non-ionic surfactants can be formulated in a wide variety of structures and those that embody the ability to lower the surface tension of aqueous solutions and that are able to disperse and hold the halogenated hydrocarbon evenly throughout an oil are envisioned as being applicable to the present invention.

Any of the surfactants may be fluorinated, but particularly useful in this invention are the fluorinated non-ionic surfactants. Typical fluorosurfactants, and the preferred compounds for this invention, are Zonyl* FSN and Zonyl* FSN-100 manufactured by the Dupont Company of Wilmington, Del. Zonyl* FSN and Zonyl* FSN-100 have the general formula:

$$R_f CH_2CH_2O(CH_2CH_2O)_x H$$

where $R_f$ is $F[CF_2CF_2]_{3-8}$; and x is a number greater than 1 where an increase in x causes the molecule to become more hydrophilic which increases the solubility of the compound in water.

Zonyl* FSN is a liquid comprised of 40 percent solids, 30 percent water and 30 percent isopropyl alcohol. Zonyl* FSN-100 is a thin paste that is 100 percent solids. Zonyl* FSN-100 is the most preferred surfactant for carrying out the present invention in that it has of itself a high dielectric strength and high electrical resistivity.

The additive of the present invention is prepared by mixing or blending the halogen substituted hydrocarbon with the surfactant. This mixing is preferably done anaerobically under a pure nitrogen or other inert gas atmosphere. When mixing one of the halogen substituted hydrocarbons, such as dibromotetrafluoroethane, with Zonyl* FSN the resulting mixture must be gently heated to remove the isopropyl alcohol from the mixture. The preferred mixture of dibromotetrafluoroethane and Zonyl* FSN-100 is prepared by mixing or blending the liquid and the paste together under a nitrogen atmosphere.

In order to achieve the even dispersion of the halogenated hydrocarbon in the oil through the interaction of the surfactant with the oil, a minimum volume of surfactant equivalent to one-tenth of the volume of the halogenated hydrocarbon that is to be added must be added to form the additive of the present invention.

When the additive is added to transformer oil, a useful percentage of halogenated hydrocarbons in relation to the final blend of oil, surfactant, and halogenated hydrocarbon is between 2 and 10 percent with the most preferred range being between 3 and 5 percent halogenated hydrocarbon to final blend of oil plus additive. The most useful range of surfactant to be added relative to the final blend of oil, surfactant, and halogenated hydrocarbon is between 0.2 and 10 percent with the most preferred range being between 0.3 and 3 percent surfactant to final volume of oil plus additive.

Thus, the final concentration of halogenated hydrocarbon and surfactant in the final blend of oil plus additive has an effective range of between 2.2 and 20 percent additive to total volume of oil blend with the most preferred range being between 3.3 and 8 percent.

The oil used in transformers come from a variety of sources such as petroleum based naphthenic oils, petroleum based paraffinic oils, vegetable oils, mineral oils and synthetic oils. Currently, the most commonly used oils are petroleum based naphthenic and paraffinic oils that are typically $C_{20}$–$C_{24}$ alkyls. It is presently believed that the most useful oil with which the additive of this invention may be combined is that oil described in my copending application entitled "An Oil For Use In Transformers and High Temperature Applications" filed on Dec. 8, 1987, which is incorporated herein by reference. Therefore, the most useful oil currently believed to be used with the additive of this invention is a triacylglycerol oil having at least 45 percent $C_{22}$ alkene composition having a single double bond between the number 9 and 10 carbons, counting from the methyl end of the molecule, as a functional group on the triacylglycerol, molecule and the most preferred oil is a 100 percent by weight $C_{22}$ alkene triacylglycerol oil having a double bond between the number 9 and 10 carbons, counting from the methyl end of the molecule, as a functional group on the triacylglycerol molecule and is in the cis configuration.

The additive mixture of the present invention is added directly to the transformer oil and mixed therewith by any various method or, preferably, the additive mixture is first blended with a small volume of the oil to be used and then poured into the remaining volume of transformer oil so that a better blend is achieved and easier pouring and handling is effected.

When the additive mixture of the present invention is added to transformer oil, the operational life span of the oil is increased and the operational parameters of the oil are enhanced. The rate of auto-oxidation of the oil is retarded by addition of the additive of this invention and the problems associated with accumulation of water in the transformer oil are greatly reduced. The addition of the mixture of the present invention to an oil also raises the oil's flash-point and auto-ignition temperatures.

A surprising feature of this invention is the ability of the mixture to protect itself. A halogenated hydrocarbon will become caustic if it reacts with water and can harm the transformer. But the water produced in a transformer oil is taken up by the surfactant, and especially by fluorosurfactants, and rendered essentially non-reactive with the halogenated hydrocarbon. The surfactant can degrade under high temperatures, but this process is slowed by the presence of the halogenated hydrocarbon in the mixture.

The invention is further exemplified with reference to the following examples.

EXAMPLE 1

In a transformer vessel to which a dielectric fluid is to be added, on a percentage basis, a volume of dibromotetrafluoroethane sufficient to achieve a 4 percent final volume of dibromotetrafluoroethane in the fluid is mixed and blended with a volume of Zonyl* FSN-100 sufficient to achieve a 0.5 percent final volume of Zonyl* FSN-100 in the fluid under a pure nitrogen atmosphere.

This mixture is then added and mixed with a volume of petroleum based paraffinic oil sufficient to achieve a 95.5 percent final volume of oil in the fluid. This mixing can be done within the transformer vessel or outside the vessel and subsequently poured into the vessel after the mixing step. This final fluid serves as a dielectric fluid into which a transformer is immersed.

EXAMPLE 2

In a transformer vessel to which a dielectric fluid is to be added, on a percentage basis, a volume of bromochloromethane sufficient to achieve a 5 percent final volume of bromochloromethane in the fluid is mixed and blended with a volume of Zonyl* FSN sufficient to achieve a 3 percent final volume of Zonyl* FSN in the fluid. This mixture is gently heated to distill the isopropyl alcohol and water components of Zonyl* FSN out of the mixture.

This mixture is then added and mixed with a volume of glyceryl trierucate oil sufficient to achieve a 92 percent final volume of oil in the fluid. This mixing can be done within the transformer vessel or outside the vessel and subsequently poured into the vessel after the mixing step. This final fluid serves as a dielectric fluid into which a transformer is immersed.

From the foregoing it will be seen that this invention is one well adapted to attain all the ends and objects hereinabove set forth, together with the other advantages that are obvious and that are inherent to the invention.

It will be understood that certain features and subcombinations are of utility and may be employed without reference to other features and subcombinations. This is contemplated by and is within the scope of the claims.

Since many possible embodiments may be made of the invention without departing from the scope thereof, it is understood that all matter herein set forth or shown in the examples is to be interpreted as illustrative and not in a limiting sense.

Having thus described my invention, I claim:

1. An additive for a dielectric oil comprising: a halogenated hydrocarbon; and
a surfactant;
said halogenated hydrocarbon being a liquid up to at least 70° F.

2. The additive as recited in claim 1 wherein said halogenated hydrocarbon is selected from the group comprising $C_1$ to $C_3$ alkanes.

3. The additive as recited in claim 2 wherein said halogenated hydrocarbon group is dibromotetrafluoroethane having a chemical formula of $C_2F_4Br_2$, dibromodifluoromethane having a chemical formula of $CF_2Br_2$, and bromochloromethane having a chemical formula of $CH_2BrCl$.

4. The additive as recited in claim 3 wherein said halogenated hydrocarbon is dibromotetrafluoroethane.

5. The additive as recited in claim 1 wherein said fluorosurfactant has the general formula $$R_fCH_2CH_2O(CH_2CH_2O)_xH$$

where
$R_f$ is $F[CF_2CF_2]_{3-8}$ and
x is a number greater than 1.

6. The additive as recited in claim 1 wherein said halogenated hydrocarbon and said surfactant are combined in at least a 10:1 ratio respectively.

7. The additive as recited in claim 6 wherein said surfactant is added in excess of said 10:1 ratio.

8. An additive for a dielectric oil comprising:
a halogenated hydrocarbon of the formula $C_nZ$
where n is the number of carbons of the hydrocarbon and is between 1 and 3 inclusive, and
Z is any combination of hydrogen, bromine, fluorine, chlorine, iodine or astatine atoms sufficient to fill the bonding orbitals of the carbon molecules of the hydrocarbon; and
a fluorosurfactant;
said halogenated hydrocarbon being a liquid up to at least 70° F.

9. An additive as recited in claim 8 wherein said halogenated hydrocarbon is an alkane.

10. A dielectric fluid for electrical transformers comprising:
a halogenated hydrocarbon;

a surfactant; and an oil;

said halogenated hydrocarbon being a liquid up to at least 70° F.

11. A dielectric fluid as recited in claim 10 wherein said oil is selected from the group comprised of petroleum based naphthenic oils, petroleum based paraffinic oils, vegetable oils, mineral oils and synthetic oils.

12. A dielectric fluid as recited in claim 11 wherein said oil is petroleum based paraffinic oils or vegetable oils.

13. A dielectric fluid as recited in claim 12 wherein said oil is glyceryl trierucate.

14. A dielectric fluid as recited in claim 10 wherein said halogenated hydrocarbon is selected from the group comprising $C_1$ to $C_3$ alkanes.

15. A dielectric fluid as recited in claim 14 wherein said halogenated hydrocarbon group is dibromotetrafluoroethane having a chemical formula of $C_2F_4Br_2$, dibromodifluoromethane having a chemical formula of $CF_2Br_2$, and bromochloromethane having a chemical formula of $CH_2BrCl$.

16. A dielectric fluid as recited in claim 15 wherein said halogenated hydrocarbon is dibromotetrafluoroethane.

17. A dielectric fluid as recited in claim 10 wherein said surfactant is selected from the group comprising non-ionic surfactants.

18. A dielectric fluid as recited in claim 17 wherein said non-ionic surfactant is a non-ionic fluorosurfactant.

19. A dielectric fluid as recited in claim 18 wherein said fluorosurfactant has the general formula $$R_fCH_2CH_2O(CH_2CH_2O)_xH$$

where $R_f$ is $F[CF_2CF_2]_{3-8}$ and x is a number greater than 1.

20. A dielectric fluid as recited in claim 10 wherein said halogenated hydrocarbon and said surfactant are combined in at least a 10:1 ratio respectively.

21. A dielectric fluid as recited in claim 20 wherein said surfactant is added in excess of said 10:1 ratio.

22. A dielectric fluid as recited in claim 10 wherein said halogenated hydrocarbon is between 2 and 10 percent of the final volume of said dielectric fluid.

23. A dielectric fluid as recited in claim 22 wherein said halogenated hydrocarbon is between 3 and 5 percent of the final volume of said dielectric fluid.

24. A dielectric fluid as recited in claim 10 wherein said surfactant is between 0.2 and 10 percent of the final volume of said dielectric fluid.

25. A dielectric fluid as recited in claim 24 wherein said surfactant is between 0.3 and 3 percent of the final volume of said dielectric fluid.

26. A method of preparing a dielectric fluid comprising the steps of: combining a halogenated hydrocarbon and a surfactant; blending said combination to form a mixture; mixing said mixture with a small volume of dielectric fluid to form a blend; and adding said blend to a large volume of dielectric fluid.

27. The method as recited in claim 26 wherein said combining and blending steps are performed anaerobically under an inert gas atmosphere.

28. A method of protecting a dielectric fluid from decomposition comprising the steps of adding to said fluid an effective quantity of a halogenated hydrocarbon and a surfactant, said halogenated hydrocarbon being a liquid at room temperature.

29. A method as recited in claim 28 wherein said halogenated hydrocarbon is selected from the group.

30. A method as recited in claim 29 wherein said halogenated hydrocarbon group is dibromotetrafluoroethane having a chemical formula of $C_2F_4Br_2$, dibromodifluoromethane having a chemical formula of $CF_2Br_2$, and bromochloromethane having a chemical formula of $CH_2BrCl$.

31. A method as recited in claim 30 wherein said halogenated hydrocarbon is dibromotetrafluoroethane.

32. A method as recited in claim 28 wherein said surfactant is selected from the group comprising non-ionic surfactants.

33. A method as recited in claim 32 wherein said non-ionic surfactant is a non-ionic fluorosurfactant.

34. A method as recited in claim 33 wherein said fluorosurfactant has the general formula $$R_fCH_2CH_2O(CH_2CH_2O)_xH$$

where $R_f$ is $F[CF_2CF_2]_{3-8}$ and x is a number greater than 1.

35. A method as recited in claim 28 wherein said halogenated hydrocarbon and said surfactant are combined in at least a 10:1 ratio respectively.

36. A method as recited in claim 35 wherein said surfactant is added in excess of said 10:1 ratio.

* * * * *